US007290664B2

(12) United States Patent
Kono et al.

(10) Patent No.: US 7,290,664 B2
(45) Date of Patent: Nov. 6, 2007

(54) CORRUGATED BOARD PACKAGING ASSEMBLY

(75) Inventors: Fumitaka Kono, Osaka (JP); Yoshio Enomoto, Osaka (JP); Akiji Sejima, Osaka (JP)

(73) Assignee: Tsubakimoto Chain Co., Osaka (JP)

( * ) Notice: Subject to any disclaimer, the term of this patent is extended or adjusted under 35 U.S.C. 154(b) by 0 days.

(21) Appl. No.: 11/388,841

(22) Filed: Mar. 24, 2006

(65) Prior Publication Data

US 2006/0278549 A1 Dec. 14, 2006

(30) Foreign Application Priority Data

Jun. 13, 2005 (JP) ..... 2005-172531

(51) Int. Cl.
*B65D 19/20* (2006.01)

(52) U.S. Cl. ..... 206/600; 108/51.3; 108/56.1

(58) Field of Classification Search ..... 206/386, 206/595–600; 108/51.3, 56.1, 56.3, 57.29
See application file for complete search history.

(56) References Cited

U.S. PATENT DOCUMENTS 3,797,727 A * 3/1974 Downing et al. ..... 206/600
4,085,847 A * 4/1978 Jacalone ..... 206/600
4,746,059 A * 5/1988 Jackson ..... 206/386
4,790,249 A * 12/1988 Webb ..... 108/51.3
5,441,154 A * 8/1995 Youell, III ..... 206/599
5,537,935 A * 7/1996 Otaguchi et al. ..... 108/51.3
5,934,474 A 8/1999 Renninger
6,050,410 A * 4/2000 Quirion ..... 206/386
6,070,726 A * 6/2000 Graham ..... 206/386

FOREIGN PATENT DOCUMENTS

| | | |
|---|---|---|
| EP | 0321840 | 6/1989 |
| FR | 2654703 | 5/1991 |
| GB | 796695 | 6/1958 |
| GB | 1292439 | 10/1972 |
| JP | 2000-168776 | 6/2000 |

* cited by examiner

*Primary Examiner*—Luan K Bui
(74) *Attorney, Agent, or Firm*—Dann, Dorfman, Herrell and Skillman; Henry H. Skillman

(57) ABSTRACT

To provide a corrugated board packaging assembly, in which its assembly and disassembly is easy, there is no bulky storage, and handling of a set during storage and transfer is possible, and which is suitable for repeated use. In a corrugated board packaging assembly 1 having a corrugated board box body 2*b* and a corrugated board pallet 12, the corrugated board box body 2 comprises a lid 3 and a foldable shell frame 4, the corrugated board pallet 12 has a side flaps for fitting the shell frame 4 into the corrugated board pallet 12, on the top of the corrugated board pallet 12, the shell frame 4 is folded to be accommodated inside the side flaps 17 before assembly of the corrugated board packaging assembly 1, and a lower outside surface of the shell frame 4 is removably fitted into the inside surfaces of the side flaps 17 to be assembled during the assembly of the corrugated board packaging assembly 1.

11 Claims, 13 Drawing Sheets

CORRUGATED BOARD PACKAGING ASSEMBLY

The present invention relates to a corrugated board packaging assembly, which has a corrugated board box body and a corrugated board pallet. Corrugated board comprises two or more planar layers with corrugated layers bonded between the planar layers.

BACKGROUND OF THE INVENTION

As a pallet used in a loading operation with a fork lift or a hand lift, together with a packaging box, a wooden pallet or a plastic pallet has been generally used. However, when the wooden pallet is used to export products, the wooden pallet must be subjected to fumigation treatment for extermination of harmful insects at required temperatures and for required times. Thus a corrugated board pallet in which harmful insects can not be in hiding has been variously developed.

Further, a corrugated board packaging assembly has been proposed having a corrugated board box body and a corrugated board pallet. That is there is a corrugated board packaging assembly, comprising a corrugated board pallet including a corrugated board upper plate, a corrugated board lower plate, and a plurality of corrugated board beams bond-fixed to between said corrugated board upper plate and said corrugated board lower plate so that a fork insert space portion is formed by said corrugated board upper plate, said corrugated board lower plate, and said plurality of corrugated board beams; and a corrugated board box body into which the package contents are accommodated. The proposed assembly is characterized in that in said corrugated board pallet a front side and a rear side of the corrugated board upper plate forming the opening portion of the fork insertion space are provided with at least four cutout portions, a frame portion of a single-use measure-shaped frame portion in which the corrugated board box body is accommodated is bonded to the upper portion of the corrugated board upper plate, and that by use of the cutout portions the article-accommodated corrugated board box body and the corrugated board pallet is secured by a band-shaped fastening material, for example as disclosed in Japanese Laid-Open Patent Publication No. 2000-168776.

Since a corrugated board packaging assembly in the proposed assembly does not use a wooden pallet, nailing is not needed during the assembly and the assembly and disassembly of the corrugated board packaging assembly is easy, and further, no fumigation treatment for the wooden pallet is needed at exportation. Further, the corrugated board packaging assembly can be taken apart at the destination of the shipment, and disposal or recycling of the corrugated board packaging assembly is possible.

However, in the previously proposed corrugated board packaging assembly. there is no consideration to storage of the corrugated board pallet and corrugated board assembly body before assembly and there is a problem in that large space is needed for storage.

Further, from the viewpoint of resource savings it is required to repeatedly ship the corrugated board packaging assembly between the origin and destination of the transfer for repeated use. To use the corrugated board packaging assembly repeatedly it is necessary to fold a disassembled corrugated board packaging assembly to be miniaturized for the sake of improvement of easy-handling during storage and transfer of disassembled corrugated board packaging components.

However, the corrugated board packaging assembly disclosed in the above-mentioned proposed assembly has a problem that even in a case where the corrugated board packaging assembly is returned after the disassembly and used repeatedly, large space is needed during storage and transfer of disassembled corrugated board packaging components.

Accordingly, the object of the present invention is to provide a corrugated board packaging assembly, in which its erection and folding away is easy, there is no bulky storage, and handling of a set during storage and transfer is possible, and which is suitable for repeated use.

The invention is a corrugated board packaging assembly having a corrugated board box body and a corrugated board pallet, characterized in that said corrugated board box body comprises a lid and a foldable shell frame, said corrugated board pallet has side flaps for fitting said shell frame into said corrugated board pallet, on the top of said corrugated board pallet, said shell frame is folded to be accommodated inside said side flaps before erection of said corrugated board packaging box, and a lower outside surface of said shell frame is removably fitted into the inside surfaces of said side flaps to be assembled during the erection of said corrugated board packaging box.

According to the invention, since in a corrugated board packaging assembly having a corrugated board box body and a corrugated board pallet, said corrugated board box body comprises a lid and a foldable shell frame, said corrugated board pallet has side flaps for fitting said shell frame into said corrugated board pallet, on the top of said corrugated board pallet, said shell frame is folded to be accommodated inside said side flaps before erection of said corrugated board packaging box, and a lower outside surface of said shell frame is removably fitted into the inside surfaces of said side flaps to be assembled during the erection of said corrugated board packaging box, the following effects are obtained. That is since before the erection of the corrugated board packaging box, the shell frame is folded and accommodated inside the side flaps, and a bulky structure is prevented whereby space savings during storage is obtained. Further, since a lower outside surface of said shell frame is removably fitted into the inside surfaces of said side flaps to be assembled during the erection of said corrugated board packaging box, the assembling by nailing every time as in a case where a wooden pallet is used is not needed. Thus the assembly of the corrugated board packaging box is easy. Further, at the folding away of the corrugated board packaging box, the disassembly can be made by only pulling out the shell frame fitted into the inside surfaces of the side flaps and the erection of the corrugated board packaging box is easy. Further, since, at the storage of the folded corrugated packaging box, the shell frame pulled out of the inside surfaces of the side flaps can be folded and accommodated into the inside of the side flaps, a bulky structure is prevented and space-savings during storage in repeated use and during transfer for the return are obtained so that repeated use is preferred. Further, since the entire corrugated board packaging assembly is made of a corrugated board, it is lightweight and the entire corrugated board packaging assembly can be handled as one set during storage and transfer. Thus the handlability of the corrugated board packaging assembly during storage and transfer is good. Further, when a wooden pallet is used the wooden pallet must be subjected to fumigation treatment for extermination of harmful insects, which can be in hiding in wood, at the export. However, since the entire corrugated board packaging assembly including the pallet are made of a corrugated board, which is not subject to infestation, it can be exported without further treatment at the export.

BRIEF DESCRIPTION OF THE DRAWINGS

FIG. 10(A) is a development view of a blank for one of the shell frame members, and FIG. 10(B) is a development view of a blank for the other shell frame member.

FIG. 18(A) is a front view thereof and FIG. 18(B) is a top view, and FIG. 18(C) is a cross-sectional view thereof.

DESCRIPTION OF A PREFERRED EMBODIMENT

Figure 1:
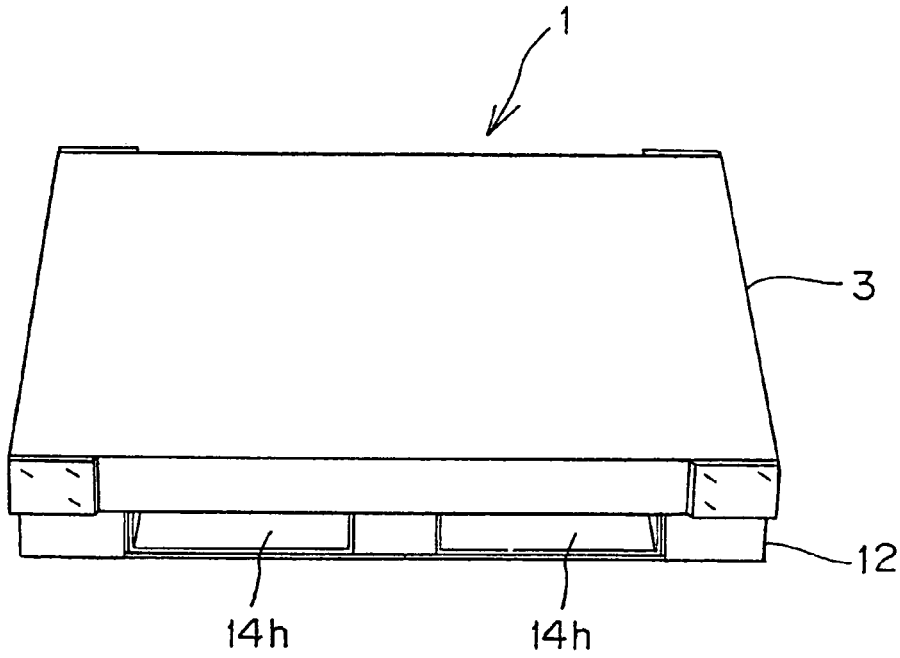
FIG. 1 is a perspective view of a preferred embodiment of a corrugated board packaging assembly, showing a folded-away state before erection.

As the best mode of the corrugated board packaging assembly according to the present invention, in a corrugated board packaging assembly 1 having a corrugated board box body 2 and a corrugated board pallet 12, the corrugated board box body 2 comprises a lid 2 and a foldable shell frame 4, and the corrugated board pallet 12 has a flap 17 into which the shell frames 4 are fitted, at the upper portion, the shell frame 4 is folded and accommodated inside the side flaps 17 before the assembly of the corrugated board packaging assembly 1, and a lower outside surface of the shell frame 4 is removably fitted into the inside of the flap 17 to be assembled during the assembly of the corrugated board packaging assembly 1. The example will be described below.

Figure 4:
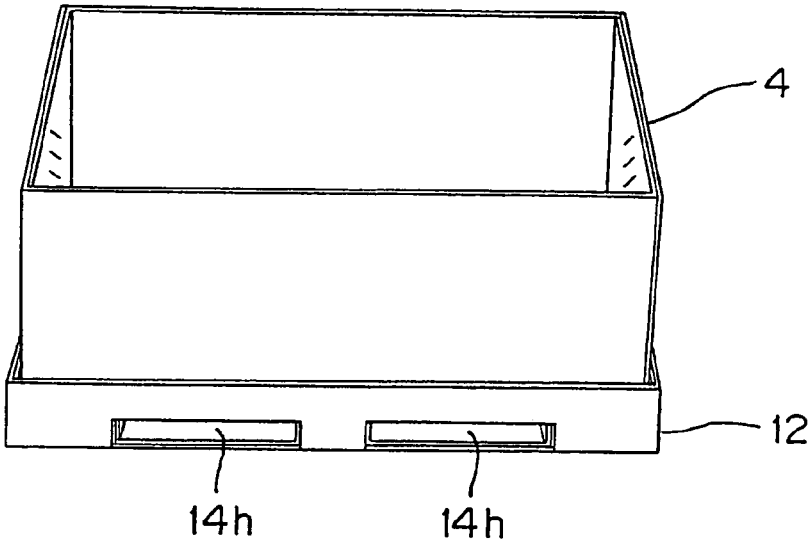
FIG. 4 is a perspective view, showing a state where the corrugated board shell frame is fitted into the corrugated board pallet in FIG. 3.
Figure 5:
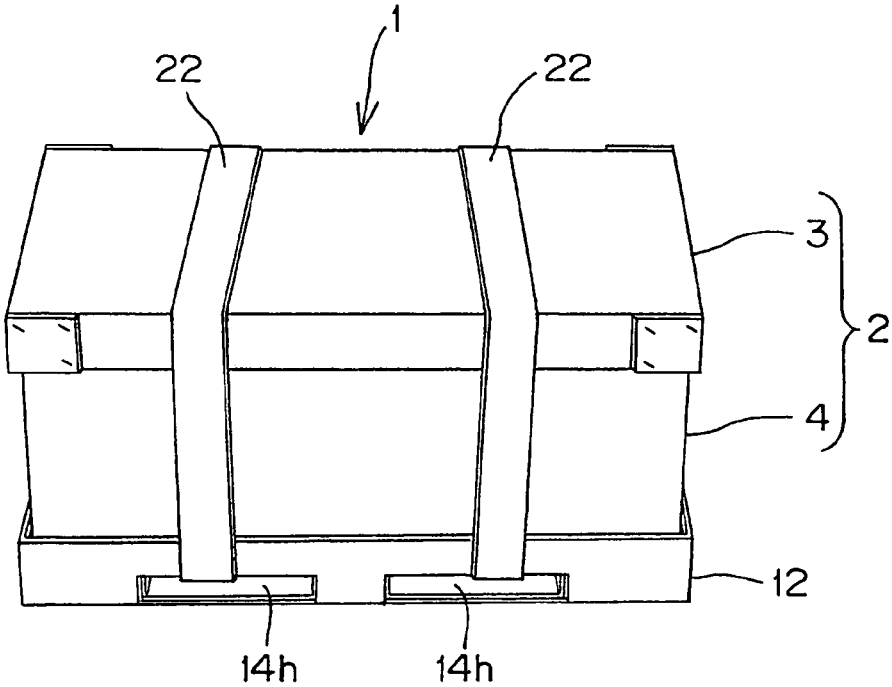
FIG. 5 is a perspective view showing a state where the corrugated board lid is secured to the corrugated board shell frame in FIG. 4.

A corrugated board packaging assembly of an example according to the present invention will be described based on FIGS. 1 to 19. A corrugated board packaging assembly 1 according to the present invention has a corrugated board box body 2 and a corrugated board pallet 12, as shown in FIG. 5. The corrugated board box body 2 comprises a corrugated board lid 3 and a foldable corrugated shell frame 4.

Figure 6:
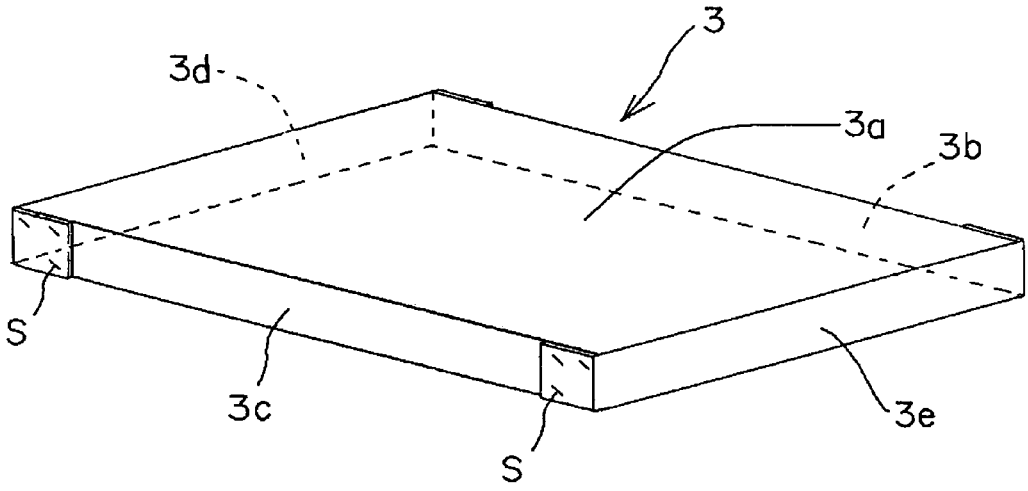
FIG. 6 is a perspective view of the corrugated board lid.

The corrugated board lid 3 forming the corrugated board box body 2 comprises a closed surface portion 3*a*, longitudinal side surface flaps 3*b*, 3*c*, which are formed by folding peripheral edges of the closed surface portion 3*a*, and width side surface flaps 3*d*, 3*e*, as shown in FIG. 6, which assumes a shallow box type as a whole with one surface opened. The corrugated board lid 3 is used for closing an open top of a corrugated board shell frame 4, which will be described later, during erection of the corrugated board packaging assembly 1 (see FIG. 5) and for closing an open portion of a corrugated board pallet 12, which will be described later, when the corrugated board packaging assembly 1 is folded away(see FIG. 1).

Figure 7:
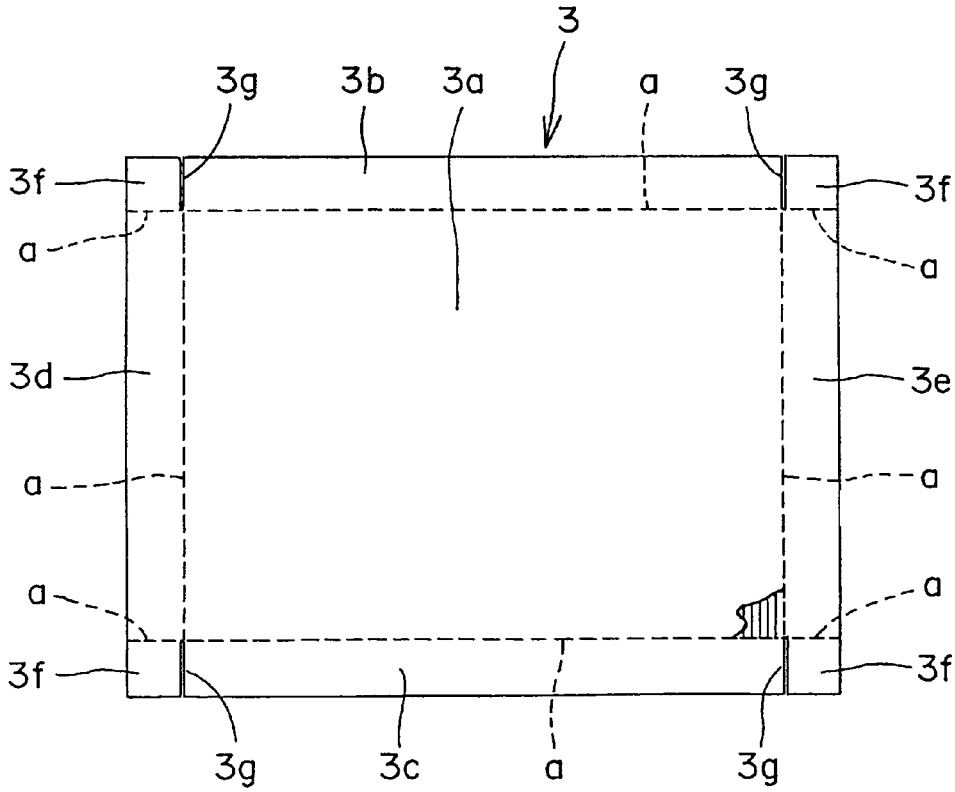
FIG. 7 is a development view of a blank for the making the corrugated board lid in FIG. 6.

This corrugated board lid 3 is formed by folding one corrugated board blank shown in FIG. 7 to be assembled. The one corrugated board blank forming the corrugated board lid 3 has a closed surface portion 3*a* formed in a rectangular shape at the center portion. And to the four side edges of the closed surface portion 3*a* are connected longitudinal side surface flaps 3*b*, 3*c* and width side surface flaps 3*d*, 3*e* through fold lines a respectively. At the ends of the width side surface flaps 3*d*, 3*e*, there are connected connecting flaps 3*f* through the fold lines a. Between the connecting flaps 3*f* and the longitudinal side surface flaps 3*b*, 3*c* are provided slit-shaped grooves 3*g* which are aligned with and extend beyond the fold lines a.

The longitudinal side surface flaps 3*b*, 3*c* and the width side surface flaps 3*d*, 3*e* are respectively folded toward the insides of the closed surface portion 3*a* through the fold lines a, and the connecting flaps 3*f* are folded toward the insides of the closed surface portion 3*a* through the fold lines a. Then the connection flaps 3*f* are overlapped on the surface sides of the longitudinal side surface flaps 3*b*, 3*c* to connect thereto. This connection is a flat stitched connection by flat stitches or staples S. Thus the corrugated board lid 3 shown in FIG. 6 is formed.

Figure 8:
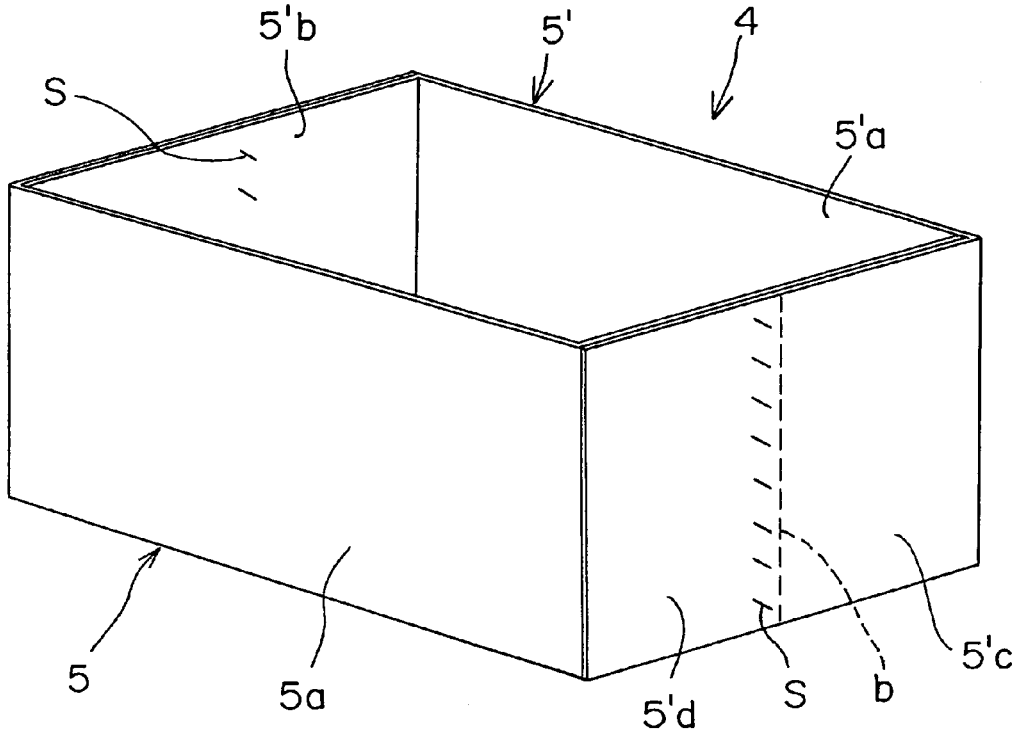
FIG. 8 is a perspective view showing a state where the corrugated board shell frame is tubulated during erection.
Figure 9:
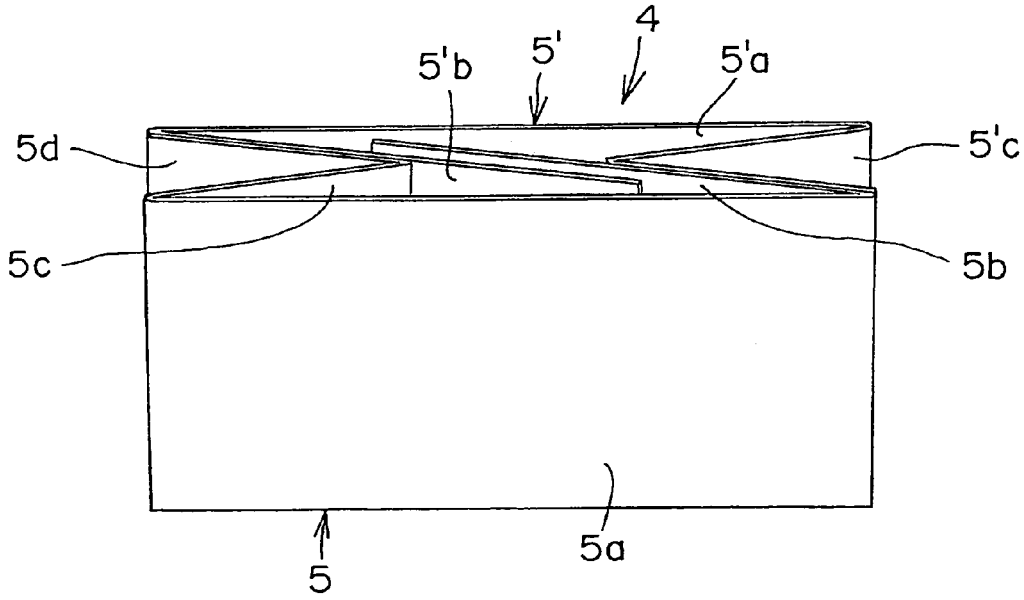
FIG. 9 is a perspective view showing a state where the corrugated board shell frame in FIG. 8 is folded.
Figure 10:
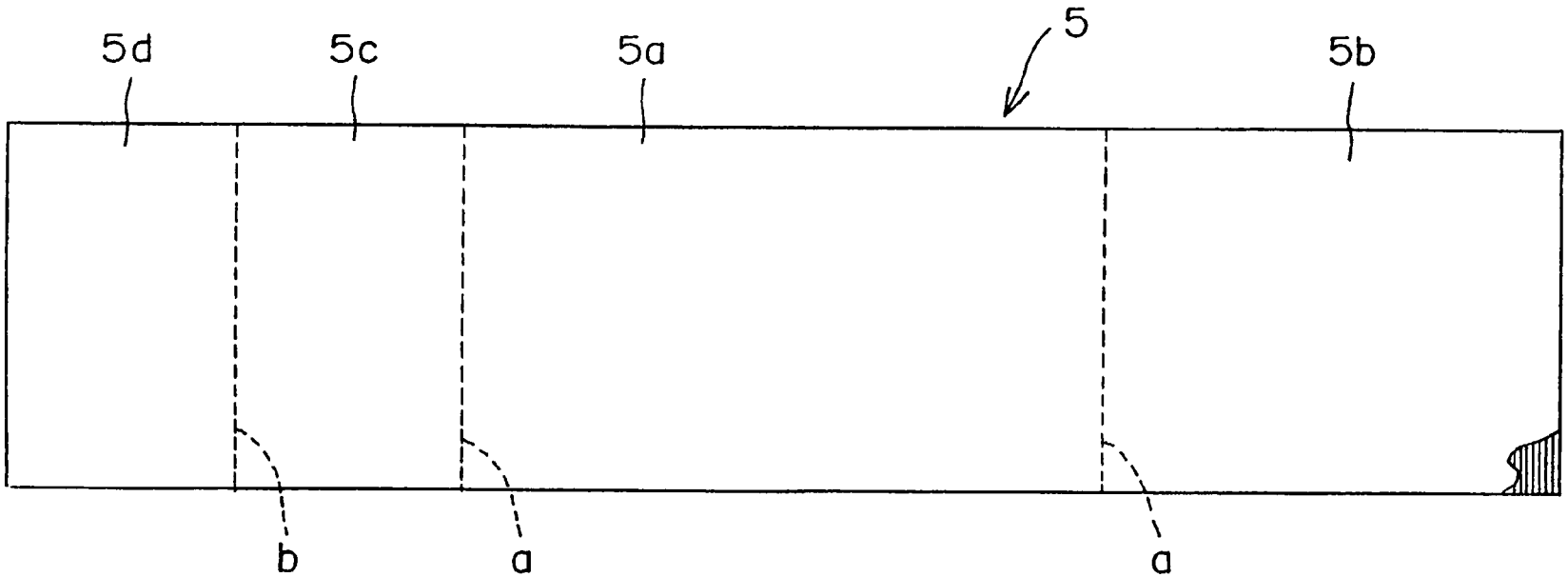
FIGS. 10(A) and 10(B) show development views of blanks for a pair of shell frame members, which are combined to form corrugated board shell frame shown in FIGS. 8 and 9, with a corner of the top layer broken away to show the direction of the corrugation in the corrugated layer, particularly.
Figure 10:
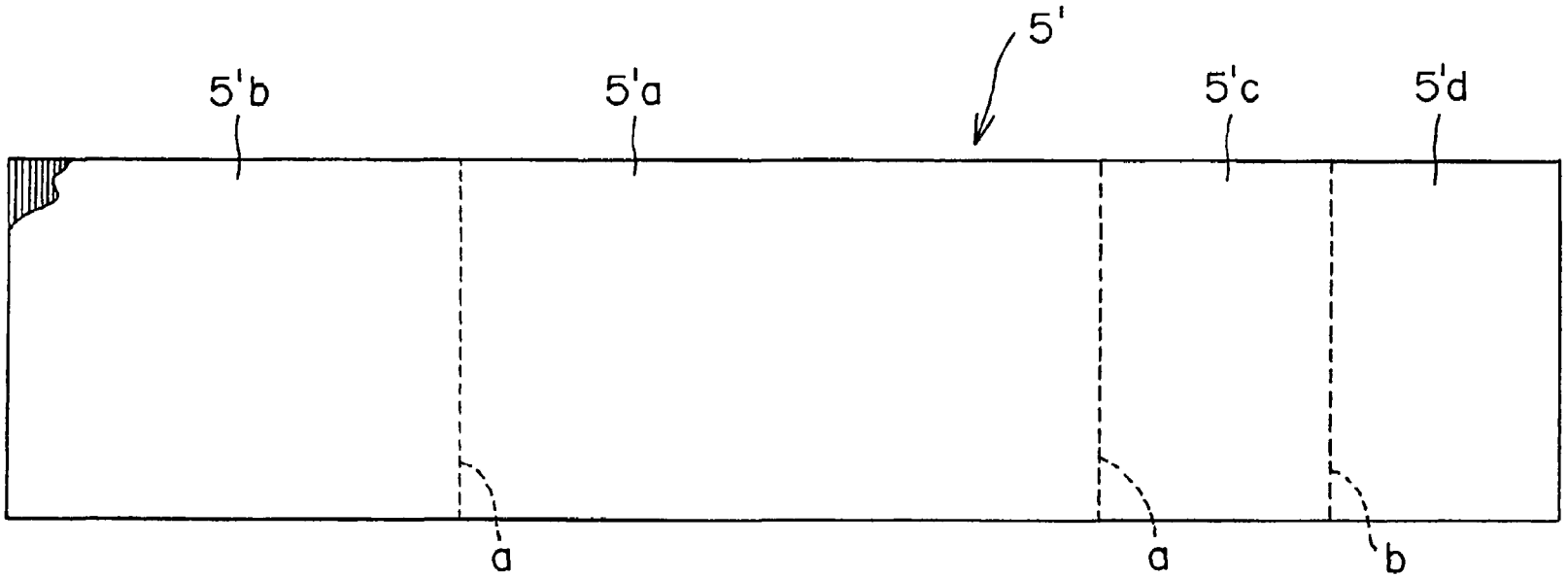

Next, a corrugated board shell frame 4 forming the corrugated board box body 2 will be described. The corrugated board shell frame 4 is of a square tubular shape with openings at the top and the bottom, as shown in FIGS. 8 and 9, and is formed by connecting a pair of shell frame members 5, 5' so as to be foldable along vertical fold lines a.

One shell frame member 5 has a longitudinal side surface portion 5*a* at the center as shown in FIG. 10(A). And a width side surface portion 5*b* is connected to one end of the longitudinal side surface portion 5*a* through the fold line a, and a width side surface portion 5*c* is connected to the other end of the longitudinal side surface portion 5*a* through the internal-fold line a, and a width side surface portion 5*d* is connected to one end of the width side surface portion 5*c* through the external-fold line b.

The other shell frame member 5' has a longitudinal side surface portion 5'*a* at the center as shown in FIG. 10(B). And a width side surface portion 5'*b* is connected to one end of the longitudinal side surface portion 5'*a* through the internal-fold line a, and a width side surface portion 5'*c* is connected to the other end of the longitudinal side surface portion 5'*a* through the internal-fold line a, and a width side surface portion 5'*d* is connected to one end of the width side surface portion 5'*c* through the external-fold line b.

The corrugated board shell frame 4 is formed by combining one shell frame member 5 and the other shell frame member 5'. That is first, one shell frame member 5 and the other shell frame member 5' are respectively folded at the internal-fold line a. Subsequently, a width side surface portion 5*c* of one shell frame member 5 is connected to a width side surface portion 5'*b* of the other shell frame member 5', and a width side surface portion 5*b* of one shell frame member 5 is connected to a width side surface portion 5'*c* of the other shell frame member 5'. These connections are flat stitch connections by the stitches or staples S. Thus, a corrugated board shell frame 4 shown in FIG. 8 is formed. Therefore, the corrugated board shell frame 4 shown in FIG. 8 is a double structure in which opposed width side surface portions are respectively formed of width side surface portions 5*b*, 5'*c*, and 5'*d*, and 5'*b*, 5*c* and 5*d*. Any weakness imparted by the fold lines b in the side surface portions 5'*c*-5'*d* is overcome by the presence of the presence of the surface portion 5*b* which has no fold line, Likewise any weakness imparted by the fold lines b in the side surface portions 5*c*-5*d* is overcome by the presence of the presence of the surface portion 5'*b* which has no fold line, Further, the corrugated board shell frame 4 can be folded at the external-fold lines b of one shell frame member 5 and the other shell frame member 5', as shown in FIG. 9. This enables the portions 5*a* and 5'*a* to overlie each other in registry.

Figure 11:
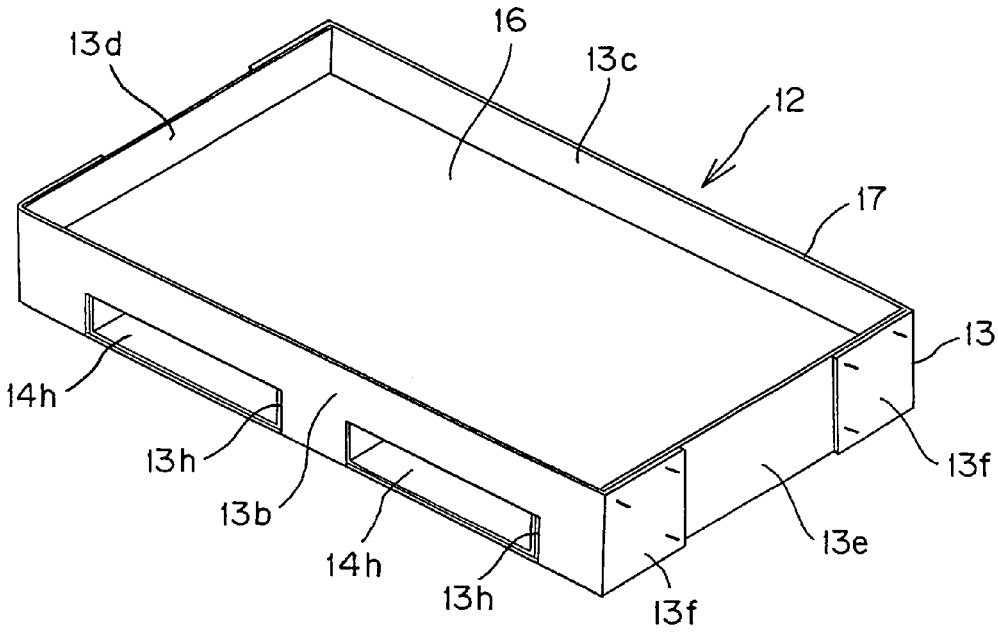
FIG. 11 is a perspective view showing the top side of a corrugated board pallet.
Figure 12:
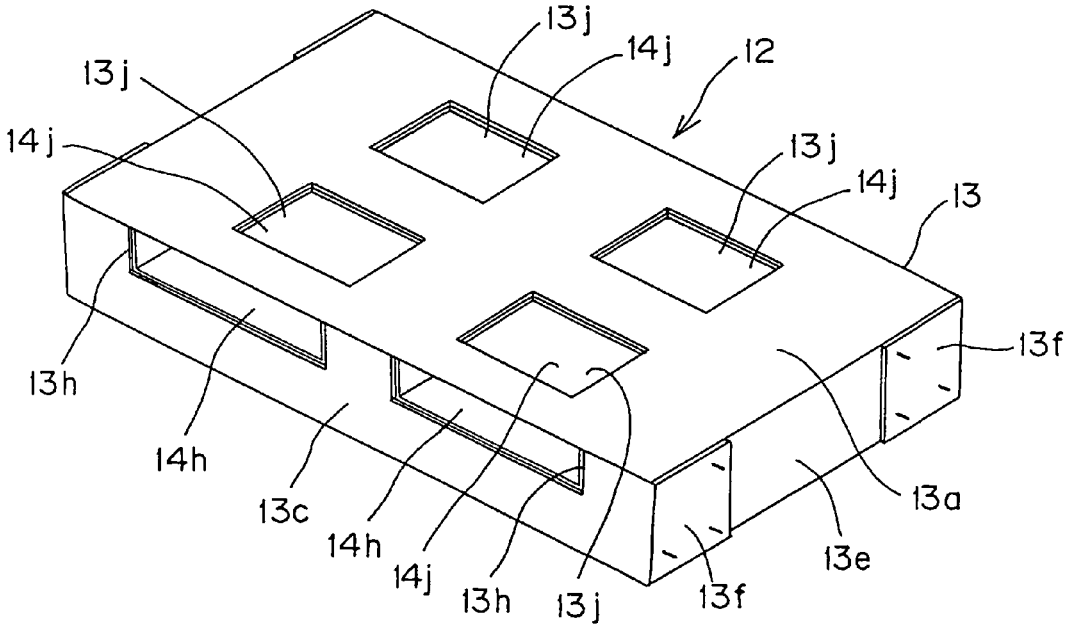
FIG. 12 is a perspective view showing the bottom side of the corrugated board pallet in FIG. 11.
Figure 13:
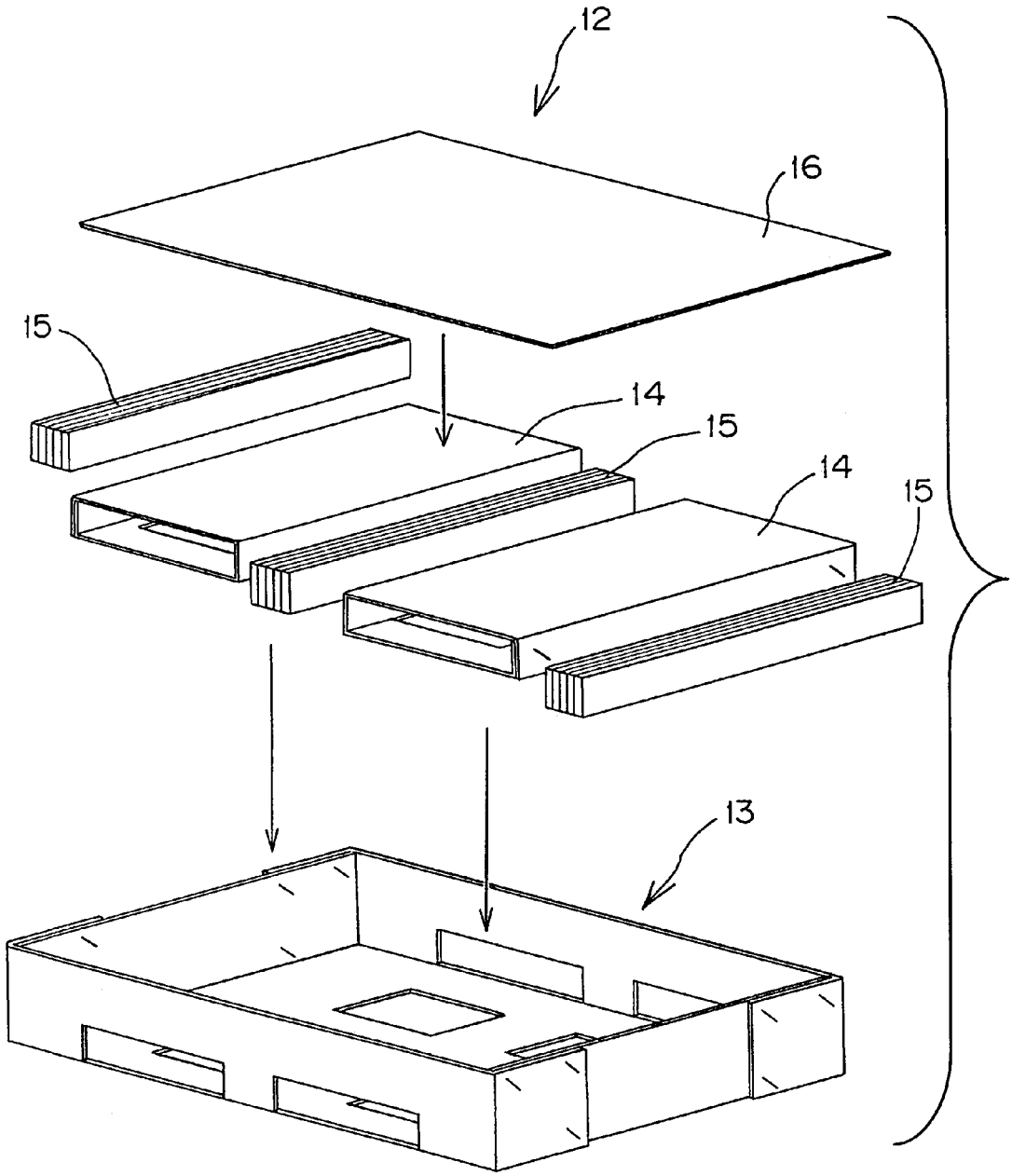
FIG. 13 is an exploded perspective view of the corrugated board pallet in FIG. 11.

Next, a corrugated board pallet 12 will be described below. The corrugated board pallet 12 is a two-way insertion pallet as shown in FIGS. 11 and 12. This corrugated board pallet 12 comprises a tray 13, two fork insertion sleeves 14, three beams 15, and a deck board 16, as shown in FIG. 13, and is formed by arranging two fork insertion sleeves 14 and three beams 15 between a bottom plate 13*a* of the tray 13 and a lower surface of the deck board 16 and bonding them with glue.

Next, the tray 13, the fork insertion sleeve 14, the beam 15 and the deck board 16 forming the corrugated board pallet 12 will be described below. The tray 13 comprises, as shown in 14, a bottom plate 13*a*, and longitudinal side surface flaps 13*b*, 13*c* and width side surface flaps 13*d*, 13*e* formed by being folded at peripheral edges of this bottom plate 13*a*, and assumes a shallow box type as a whole with one side opened. And the longitudinal side surface flaps 13*b*, 13*c* are respectively provided with two-fork insertion openings 13*h*. Further, the bottom plate 13*a* is provided with four wheel openings 13*j*.

Figure 15:
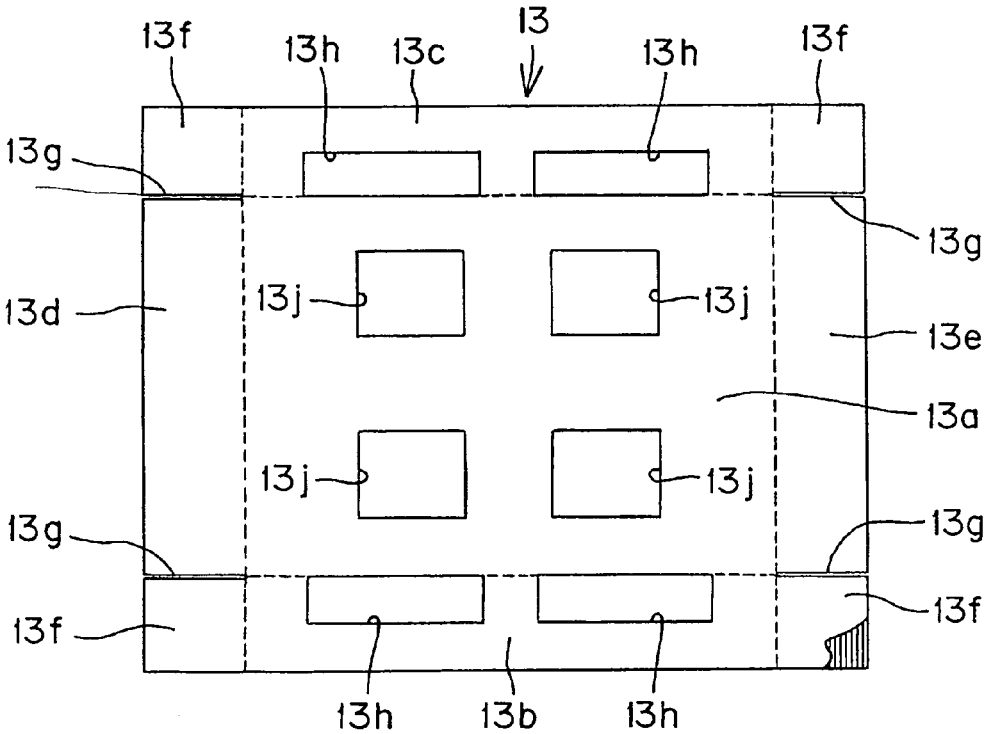
FIG. 15 is a development view of a blank for the tray in FIG. 14, with a corner of the top layer broken away to show the direction of the corrugation in the corrugated layer.

The tray 13 is formed by folding one corrugated board blank shown in FIG. 15 and assembling it. The one corrugated board blank forming the tray 13 has a rectangular bottom plate 13*a* at the center portion, and to the four-side edges of this bottom plate 13*a* are respectively connected longitudinal side surface flaps 13*b*, 13*c* and width side surface flaps 13*d*, 13*e* through fold lines a, as shown in FIG. 15. And to both ends of the longitudinal side surface flaps 13*b*, 13*c* are respectively connected connection flaps 13*f* through fold lines a, and between the connection flaps 13*f* and the width side surface flaps 13*d*, 13*e* are respectively provided slit-shaped grooves 13*g*.

Figure 14:
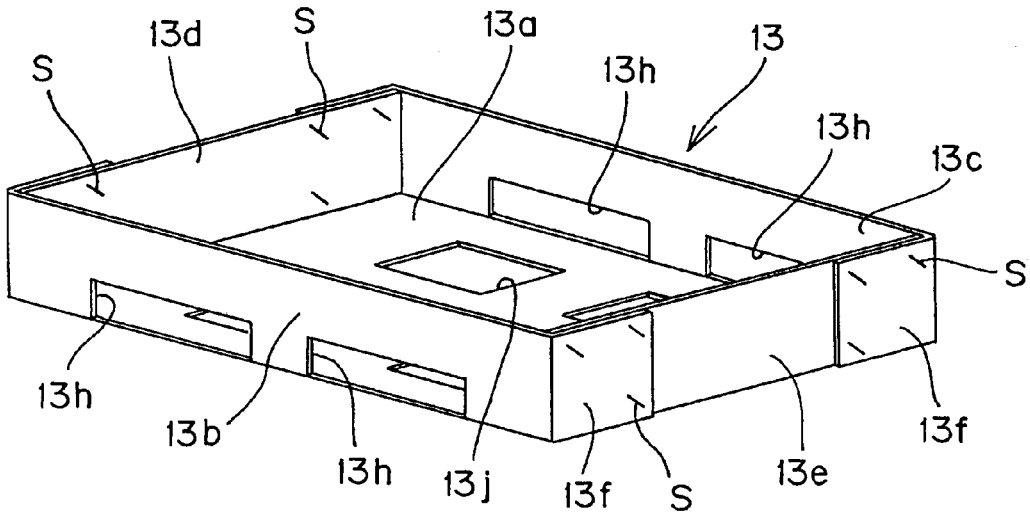
FIG. 14 is a perspective view of a bottom tray forming the corrugated board pallet in FIG. 11.

The longitudinal side surface flaps 13*b*, 13*c* and the width side surface flaps 13*d*, 13*e* are respectively folded toward the insides of the bottom plate 13*a* through the fold lines a, and the connecting flaps 3*f* are folded toward the insides of the bottom plate 13*a* through the internal fold lines a. Then the connection flaps 13*f* are overlapped on the surface sides of the width side surface flaps 13*d*, 13*e* to connect thereto. This connection is a flat stitch connection by flat stitches or staples S. Thus the tray 13 shown in FIG. 14 is formed.

Figure 16:
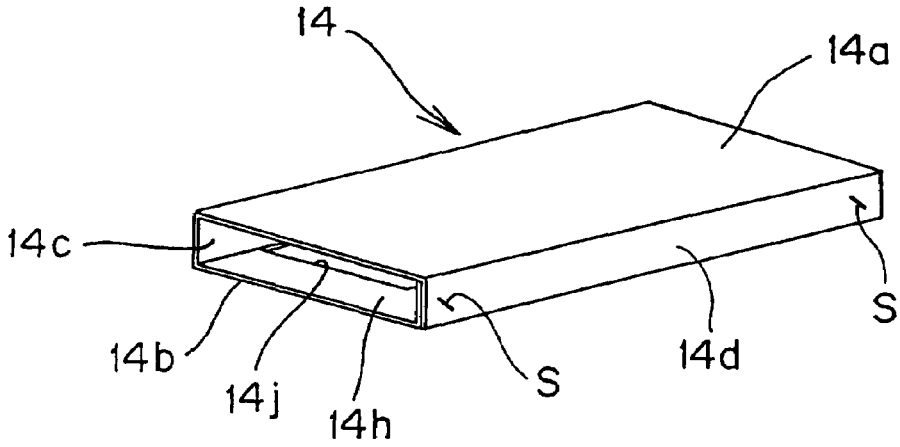
FIG. 16 is a perspective view of a fork-inserting sleeve member in the corrugated board pallet in FIG. 11.

The fork insertion sleeve 14 comprises, as shown in FIG. 16, an upper surface portion 14*a*, a lower surface portion 14*b*, side flaps 14*c*, 14*d*, and assumes a flat rectangular tubular shape as a whole with both ends opened. And the opening portions on both ends form insertion opening 14*h* for a fork. Further, the surface portions 14*b* are provided with two wheel openings 14*j*.

Figure 17:
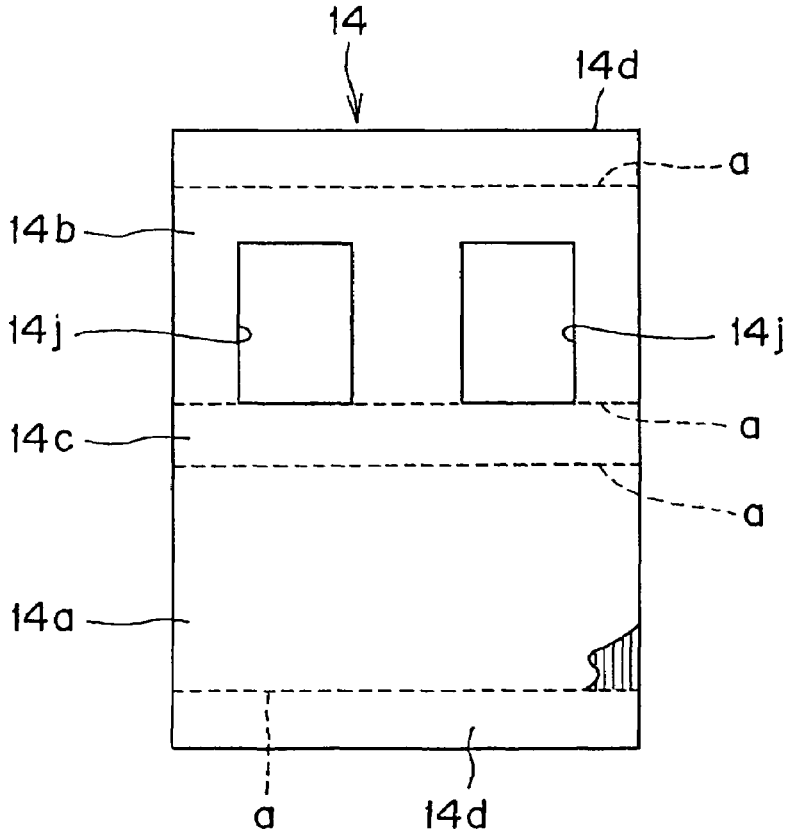
FIG. 17 is a development view of a blank for the fork-inserting sleeve of FIG. 16.
Figure 18:
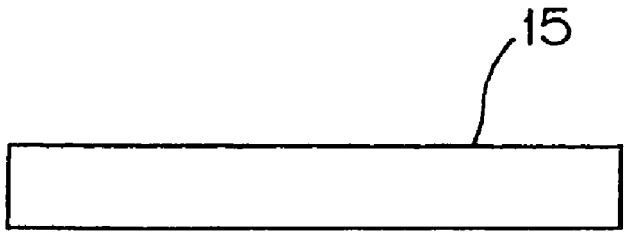
FIGS. 18(A), 18(B) and 18(C) show a beam incorporated in the corrugated board pallet in FIG. 11, particularly.
Figure 18:
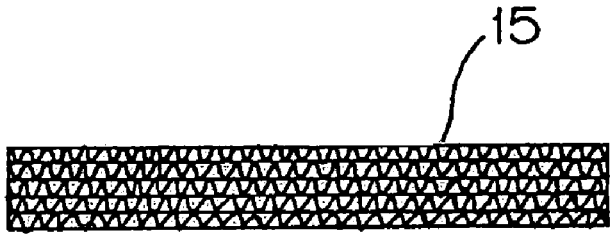
Figure 18:
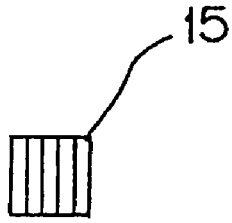

The fork insertion sleeve 14 is formed by folding one corrugated board blank shown in FIG. 17 to be assembled. In one corrugated board blank forming the fork insertion sleeve 14, to both ends of the side flap 14*c* are respectively connected the upper surface portion 14*a* and the lower surface portion 14*b* through fold lines a, and to the end portions of the upper surface portion 14*a* and lower surface portion 14*b* are.respectively connected side flaps 14*d*, as shown in FIG. 17.

The upper surface portion, 14*a*, the lower surface portion 14*b* and side flaps 14*c*, 14*d* are respectively folded inside through interior fold lines a, and the flaps 14*d* are overlapped with each other and the overlapped portions are connected to each other. This connection is a flat stitched connection with flat stitches or staples S. Thus a fork insertion sleeve 14 having a fork insertion opening 14*h* shown in FIG. 14 is formed.

Each of the beams 15 is formed of an elongated square pole-shaped corrugated board as shown in FIG. 13 and FIGS. 18(A) and 18(B), and each length and height of the beam 15 is the same length and height of the fork insertion sleeve 14. This beam is formed by laminating a plurality of elongated rectangular corrugated board sheets and gluing them with glue.

Figure 19:
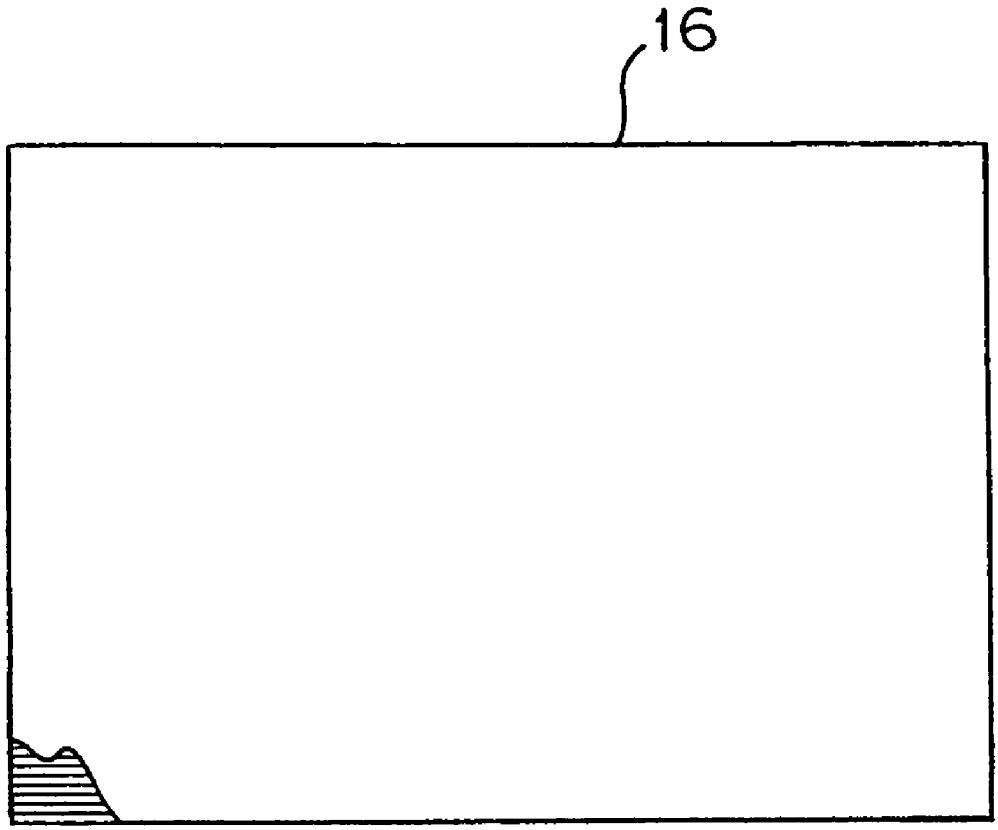
FIG. 19 is a plan view of a deck board forming the corrugated board pallet in FIG. 11, with a corner of the top layer broken away to show the direction of the corrugation in the corrugated layer.

The deck board 16 is formed of one rectangular corrugated board sheet as shown in FIGS. 13 and 19.

The corrugated board pallet 12 comprises a tray 13, two fork insertion sleeves 14, three beams 15 and a deck board 16 as mentioned above with reference to FIG. 13, and is formed by arranging two fork insertion sleeves 14 and three beams 15 between the bottom plate 13*a* and the lower surface of the deck board 16 and bonding them to each other with glue. The thus formed corrugated pallet 12 has a side flaps 17 at the top portion as shown in FIG. 11. This side flaps 17 comprises longitudinal side surface flaps 13*b*, 13*c* and width side surface side flaps 13*d*, 13*e* of the tray 13, and is a frame-shaped protrusion portion protruded from the deck board 16 surface, and vertically arises. And the side flaps 17 have a function for receiving folded shell frame 14 inside before the erection of the corrugated board packaging assembly 1, and for removably fitting a lower portion outside surface of the shell frame 4 into the inside surface during the assembly of the corrugated board packaging assembly 1. Further, in the corrugated board pallet 12, the fork insertion opening 13*h* of the tray 13 and the insertion opening 14*h* of the fork insertion sleeve 14 are aligned with each other as shown in FIGS. 11 and 12, and a wheel opening 13*j* of the tray 13 and a wheel opening 14*j* of the fork insertion sleeve 14 are also aligned with each other.

Figure 2:
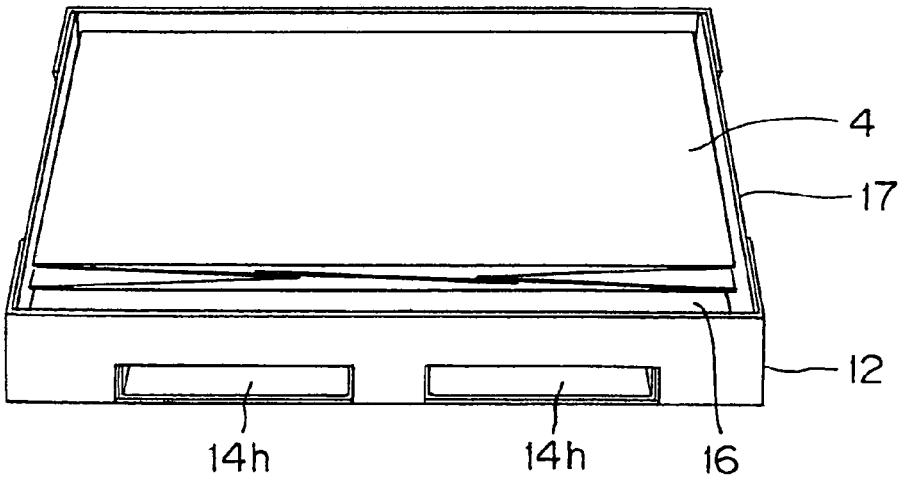
FIG. 2 is a perspective view similar to FIG>1, showing a state where a corrugated board lid was removed from the corrugated board packaging assembly.
Figure 3:
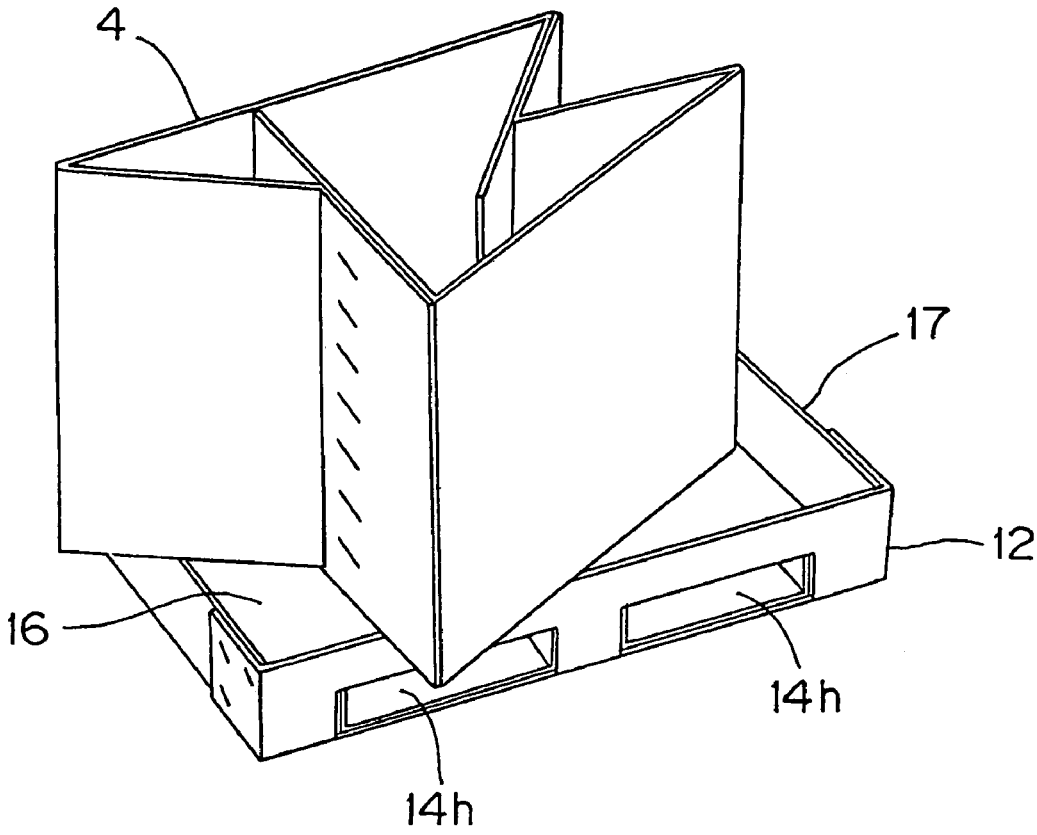
FIG. 3 is a perspective view similar to FIG>2, showing a middle state of erection in removing the corrugated board shell frame from the corrugated board pallet in FIG. 2.

Next, an assembly order of the corrugated board packaging assembly 1 will be described with reference to FIGS. 1 to 5. The corrugated board packaging assembly 1 is stored in a state shown in FIG. 1. Since the corrugated board packaging assembly 1 is compact and not bulky in this storage state, it is preferable that the storage place does not need large space. When a corrugated board lid 3 is removed from the corrugated board packaging assembly 1 shown in FIG. 1, a corrugated board shell frame 4 accommodated in a folded manner is exposed as shown in FIG. 2. Here the corrugated board shell frame 4 is removed and placed on a corrugated board pallet 12 with the folded corrugated board shell frame 4 opened slightly, as shown in FIG. 3. Subsequently, as shown in FIG. 4, the corrugated board shell frame 4 is perfectly opened and a lower outside surface of the corrugated board shell frame 4 is removably fitted into the inside surfaces of side flaps 17 of the corrugated board pallet 12 to be assembled. In a state shown in FIG. 4, an article to be accommodated is accommodated in the corrugated board shell frame 4. Subsequently, as shown in FIG. 5, the opening portion of the corrugated board shell frame 4 is closed by the corrugated board lid 3 which telescopically engages the side flaps 17, and the corrugated board lid 3, the corrugated board shell frame 4 and the corrugated board pallet 12 are bundled with a bundling member 22 (polypropylene bundling band or the like). The corrugated board packaging assembly 1 bundled with the bundling member 22 is loaded by a fork lift or a hand lift.

Next, a folding away of the corrugated board packaging assembly 1 will be described with reference to FIG. 1 to 5. The folding away of the corrugated board packaging assembly 1 is performed by the reverse order of the above-mentioned erection. That is the bundling member 22 bundles of the corrugated board packaging assembly 1 transferred in the state shown in FIG. 5 are released, and the corrugated board lid 3 is removed, and then the article accommodated in the container shown in FIG. 4 is taken out. Subsequently, the corrugated board shell frame 4 removably fitted into the inside surfaces of the side flaps 17 of the corrugated board pallet 12 is pulled out in a state shown in FIG. 4, and is placed on the corrugated board pallet 12 with the corrugated board shell frame 4 opened slightly as shown in FIG. 3. After that, as shown in FIG. 2, the pulled out corrugated board shell frame 4 is folded and accommodated inside the side flaps 17 of the corrugated board pallet 12. Since the side panels 5*a* and 5'*a* are in registry, the folded frame fits within the flaps. Subsequently, as shown in FIG. 1, the open portion of the corrugated board pallet 12 is closed by the corrugated board lid 3. And the corrugated board packaging assembly 1 is stored in the state shown in FIG. 1 for repeated use or it is transferred again to the transfer source for return. At this stage since the corrugated board packaging assembly 1 is not bulky, the space during the storage for repeated use and during retransfer for return is reduced and the repeated use is preferred.

According to the corrugated board packaging assembly 1 of the above-mentioned example, the following effects are obtained. That is since before the assembly of the corrugated board packaging assembly 1, the shell frame 4 is folded and accommodated inside the side flaps 17, and a bulky structure is prevented whereby space savings during storage is obtained.

Further, since a lower outside surface of said shell frame 4 is removably fitted into the inside surfaces of the side flaps 17 to be assembled during the erection of the corrugated board packaging assembly 1, the use of nailing every time as in a case where a wooden pallet is used is not needed. Thus the erection of the corrugated board packaging assembly 1 is easy. Further, when erecting the corrugated board packaging assembly 1, the erection can be made by only pulling out the shell frame 4 fitted into the inside surfaces of the side flaps 17 and the erection of the corrugated board packaging assembly 1 is easy.

Further, since, when storing the folded away corrugated packaging assembly 1, the shell frame 4 pulled out of the inside surfaces of the side flaps 17 can be folded and accommodated into the inside of the side flaps 17, a bulky structure is prevented and space-savings during storage in repeated use and during transfer for the return are obtained so that repeated use is available.

Further, since the entire corrugated board packaging assembly 1 is made of a corrugated board, it is lightweight and the entire corrugated board packaging assembly 1 can be handled as one set during storage and transfer. Thus the handlability of the corrugated board packaging assembly 1 during storage and transfer is good. Further, when a wooden pallet is used the wooden pallet must be subjected to fumigation treatment for extermination of harmful insects, which can be in hiding in wood, at the export. However, since the entire corrugated board packaging assembly 1 including the pallet are made of a corrugated board which is not subject to infestation, it can be exported without special treatment for export.

Further, since the corrugated board shell frame 4 is a double structure in which opposed width side surface portions are formed of width side surface portions 5*b*, 5'*c*, 5'*d*, and 5'*b*, 5*c* and 5*d* respectively, the strength and shape retention of the corrugated board shell frame 4 can be improved.

Further, since, in the corrugated board pallet 12, the fork insertion opening 13*h* of the tray 13 and the insertion opening 14*h* of the fork insertion sleeve 14 are aligned with each other, a fork can be inserted through the insertion opening 14*h* of the fork insertion sleeve 14 at the loading operation with a fork lift or a hand lift. As shown in FIG. 13, the sleeves 14 have a top wall 14*a* and a bottom wall 14*b* which respectively engage the top plate formed by the deck board 16, and the bottom plate 13*a*. Further, since, in the corrugated board pallet 12, the wheel openings 13*j* of the tray 13 and the wheel openings 14*j* of the fork insertion sleeve 14 register with each other, wheels attached to the tip of the fork in a hand lift can be received in the aligned portions of the openings 13*j* of the tray 13 and the openings 14 of the fork insertion sleeve 14 at the loading operation, and a hand lift loading operation is possible. It is noted that there are two insertion openings 14*h* on the front of the pallet and two insertion openings 14*h* on the rear side of the pallet. The openings on one side of the pallet are aligned and paired with the openings on the opposite side of the pallet, and the sleeves extend between said aligned pairs to afford insertion of forks through the openings from either side of the pallet and into the hollow of the sleeve associated with each pair. The wheel openings are four in number so that one opening registers with the tip of the fork regardless of which side of the pallet the fork is inserted through.

The invention claimed is:

1. A corrugated board packaging assembly having a corrugated board box body and a corrugated board pallet, said pallet being adapted for use with either a fork lift having forks to lift the assembly or a hand lift having forks with wheels at their tips, characterized in that said assembly may be folded into a compact unit and may be erected to provide a box body for containing a product to be shipped or stored, said corrugated board box body comprising a lid and a foldable shell frame, said corrugated board pallet comprising a top plate and a side flaps projecting above the top plate for fitting said shell frame into said corrugated board pallet, said shell frame when folded capable of being accommodated inside said side flaps, and when unfolded to be assembled by removably fitting the lower outside surface of the shell frame into the inside surfaces of said side flaps during the erection of said corrugated board packaging assembly, said pallet comprising a bottom plate spaced below said top plate, and access means below said top plate to afford entry of the forks to underlie the top plate for lifting the assembly, beams of corrugated board aligned parallel to each other and positioned between said top and bottom plates on both sides of said access means, said access means comprising openings in said side flaps below said top plate and at least two hollow sleeves extending between said beams to overlie said bottom plate, said bottom plate and said hollow sleeves having wheel openings registering with the wheels of the forks when the forks are inserted through said access means to underlie the top plate.

2. A corrugated board packaging assembly according to claim 1, wherein said side flaps projects above said top plate by a given dimension, and the thickness of said shell frame when folded is less than said given dimension.

3. A corrugated board packaging assembly according to claim 1, wherein said top plate provides a bottom for said box body when erected.

4. A corrugated board packaging assembly according to claim 1, wherein said box body lid has a top surface and four depending sides, said sides adapted to telescopically engage said side flaps of the pallet when the shell frame is folded, and to telescopically engage the upper outside surface of the shell frame when unfolded.

5. A corrugated board packaging assembly according to claim 1, wherein said shell frame comprises four vertical side panels interconnected by vertical interior fold lines, an opposite pair of said side panels having exterior vertical fold lines, enabling the shell frame to be folded with the remaining pair of side panels to overlie each other.

6. A corrugated board packaging assembly according to claim 1, wherein each said sleeve has upper and lower walls engaging said top and bottom plates respectively, said lower walls having wheel openings in registry with the wheel openings of said bottom plate.

7. A corrugated board packaging assembly according to claim 1, wherein said access means comprises two access openings on one side of the pallet and two access openings on the opposite side of the pallet, said opposite openings being aligned to afford insertion of forks through either side of the pallet.

8. A corrugated board packaging assembly according to claim 7, wherein said bottom plate has four wheel openings, two of which are adapted to register with the tips of forks inserted through one side of the pallet and two of which are adapted to register with the tips of forks inserted through the opposite side of the pallet.

9. A knock-down corrugated board packaging assembly having a corrugated board box body and a corrugated board pallet, characterized in that said assembly may be folded into a compact unit and may be erected to provide a box body for containing a product to be shipped or stored, said corrugated board box body comprising a lid and a foldable shell frame, said corrugated board pallet comprising a top plate, side flaps having upper portions projecting above the top plate for fitting said shell frame into said corrugated board pallet and lower portions depending below said top plate, said top plate providing a bottom for said box body when erected, a bottom plate supported by said lower portions of said side flaps at a position spaced below said top plate, and at least two hollow sleeves, each having top and bottom walls respectively engaging said top and bottom plates, said lower portions of said side flaps having access openings in registry with the hollow interior of said sleeves, said bottom plate and said bottom walls having registering wheel openings registering with the wheels of the forks when the forks are inserted into the hollows of said sleeves through said access openings, said shell frame comprising four panels, and having internal fold lines between said panels, said fold lines defining the corners of said shell when erected, and external fold lines in opposite panels to enable said shell when folded to be accommodated inside said side flaps, said shell frame when unfolded forming a box by removably fitting the lower outside surface of the shell frame into the inside surfaces of said side flaps during the erection of said corrugated board packaging assembly.

10. A knock-down corrugated board packaging assembly according to claim 9, wherein said side-wall lower portions have two access openings on one side of the pallet and two access openings on the opposite side of the pallet, said opposite openings being in aligned pairs, said sleeves extending between said aligned pairs of access openings affording to afford insertion of forks through either side of the pallet, and through the hollows of the sleeves.

11. A knock-down corrugated board packaging assembly according to claim 10, wherein said bottom plate has four wheel openings, two of which are adapted to register with the tips of forks inserted through one side of the pallet and two of which are adapted to register with the tips of forks inserted through the opposite side of the pallet, and each said sleeve has upper and lower walls engaging said top and bottom plates respectively, each said lower wall having two wheel openings in registry with two wheel openings of said bottom plate.

* * * * *